United States Patent [19]

Brower

[11] 4,359,081

[45] Nov. 16, 1982

[54] DOOR BARRIERS

[76] Inventor: John Brower, 29282 Sonoma Way, San Juan Capistrano, Calif. 92675

[21] Appl. No.: 318,949

[22] Filed: Nov. 6, 1981

[51] Int. Cl.[3] ..... A47G 5/02

[52] U.S. Cl. ..... 160/243; 160/28

[58] Field of Search ..... 160/25, 26, 28, 98, 160/99, 100, 133, 239, 241, 242, 243, 245

[56] References Cited

U.S. PATENT DOCUMENTS

| | | | |
|---|---|---|---|
| 778,228 | 12/1904 | Dodge et al. | 160/239 |
| 1,922,286 | 8/1933 | Gronbeck | 160/99 |
| 1,980,990 | 11/1934 | Gronbeck | 160/99 |
| 3,092,170 | 6/1963 | Ellis | 160/133 |
| 3,911,990 | 10/1975 | Hoover et al. | 160/28 |

*Primary Examiner*—Peter M. Caun

*Attorney, Agent, or Firm*—Kenneth T. Theodore

[57] ABSTRACT

The invention is a horizontally operated door barrier which presents virtually an impenetrable doorway barrier while maintaining ease of personnel access through the portal. The invention consists of a movable vertical spool upon which is wrapped a material or screen for covering the doorway. The spool moves laterally across the doorway, rolling or unrolling the screen wrapped thereon, thereby uncovering or covering the doorway. The barrier can be used to prevent passage of insects, moisture, heat, dust and like environments.

9 Claims, 3 Drawing Figures

DOOR BARRIERS

BACKGROUND OF THE INVENTION (1) Field of the Invention

This invention lies within the field of doors, specifically screen door and portal barriers.

(2) Description of Prior Art

Prior art in the form of barriers and screen doors is much in evidence in todays homes, factories and the general marketplace. For example, screen doors, having generally a rectangular metal frame with screen material stretched therein and pivoting by one edge, protects a doorway/portal from insect entry. Other screen doors may traverse horizontally on tracks.

In both instances, the doors require manual operation throughout their opening and, most importantly, operation of said doors require more space than in their closed position.

Another door/barrier common to homes is the folding partitions wherein the partition material folds accordian like, onto itself as the partition frame horizontally traverses to its open position. The main disadvantage of said partition is the large volume of space it consumes within the doorway in its open position. This greatly reduces the size of the doorway's useful opening.

SUMMARY AND OBJECTS OF THE INVENTION

The invention is a door barrier which is effortlessly operated by personnel and uses a minimum amount of space within a doorway or portal in its open mode. It consists of a horizontal track guide, mounted to the door header, upon which a vertical carrier rollably engages the guide. A vertical spool is pivotably attached to said member wherein a torsion spring such as the spiral motor type applies a continuous torque to the spool. Flexable material, such as insect screen, is vertically attached to one side of the doorway with the other edge of the screen rolled upon said spool. A housing circumscribes the spool for its full length and has a slot thereon through which the material passes. In operation, the member horizontally traverses across the doorway to a open or closed position such that the material is rolled or unrolled upon the spool, thereby respectively uncovering or covering the doorway.

It is an object of the invention to provide a door barrier which is an effective barrier to many types of elements and is almost effortless to use and operate. Additionally, it is an object of the invention to provide a door barrier operating from an overhead track system by which the screen material is constantly kept taut at all times by being rolled upon a spring activated spool.

Further, it is an object of the invention to provide a door barrier which requires a minimum amount of space in which to operate or store in the open mode.

DESCRIPTION OF THE PREFERRED EMBODIMENT

While the preferred embodiment is illustrated and described below, it is to be understood that variations will be apparent to those skilled in the art without departing from the principles of the invention. Accordingly, the invention is not to be limited to the specific form as described and illustrated but rather is to be limited only by a literal interpretation of the claims appended herein.

Figure 1:
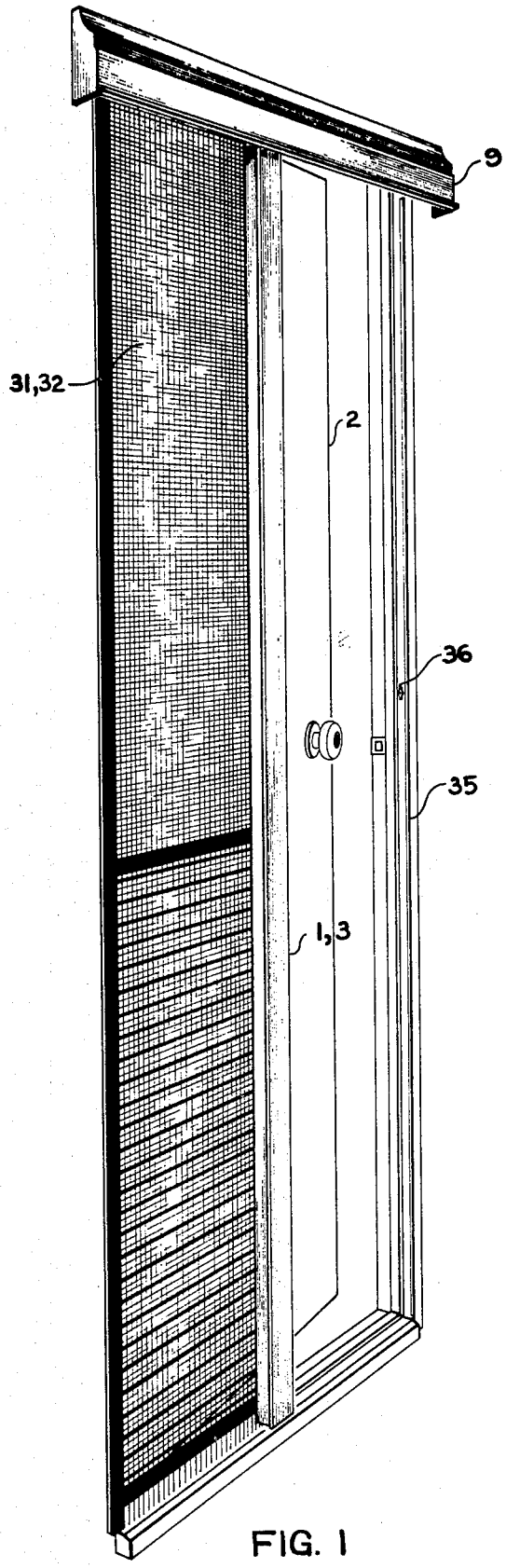
FIG. 1 is a perspective view of the invention installed on and within a doorway in a partially opened position.
Figure 3:
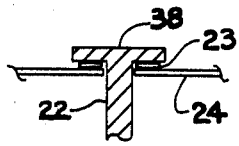
FIG. 3 is a sectional view showing the arrangement of the shaft and bearing attachment.

FIG. 1 illustrates the invention, a door barrier 1 installed within a doorway in a half open/closed position. A standard door 2 is also illustrated to show said barrier's 1 compatability with existing doors and the like. For purposes of teachings only and not to restrict the scope and use of said invention, the barrier 1 is illustrated and described herein as installed on a standard doorway and opens by moving to the left and closes by moving to the right.

Figure 2:
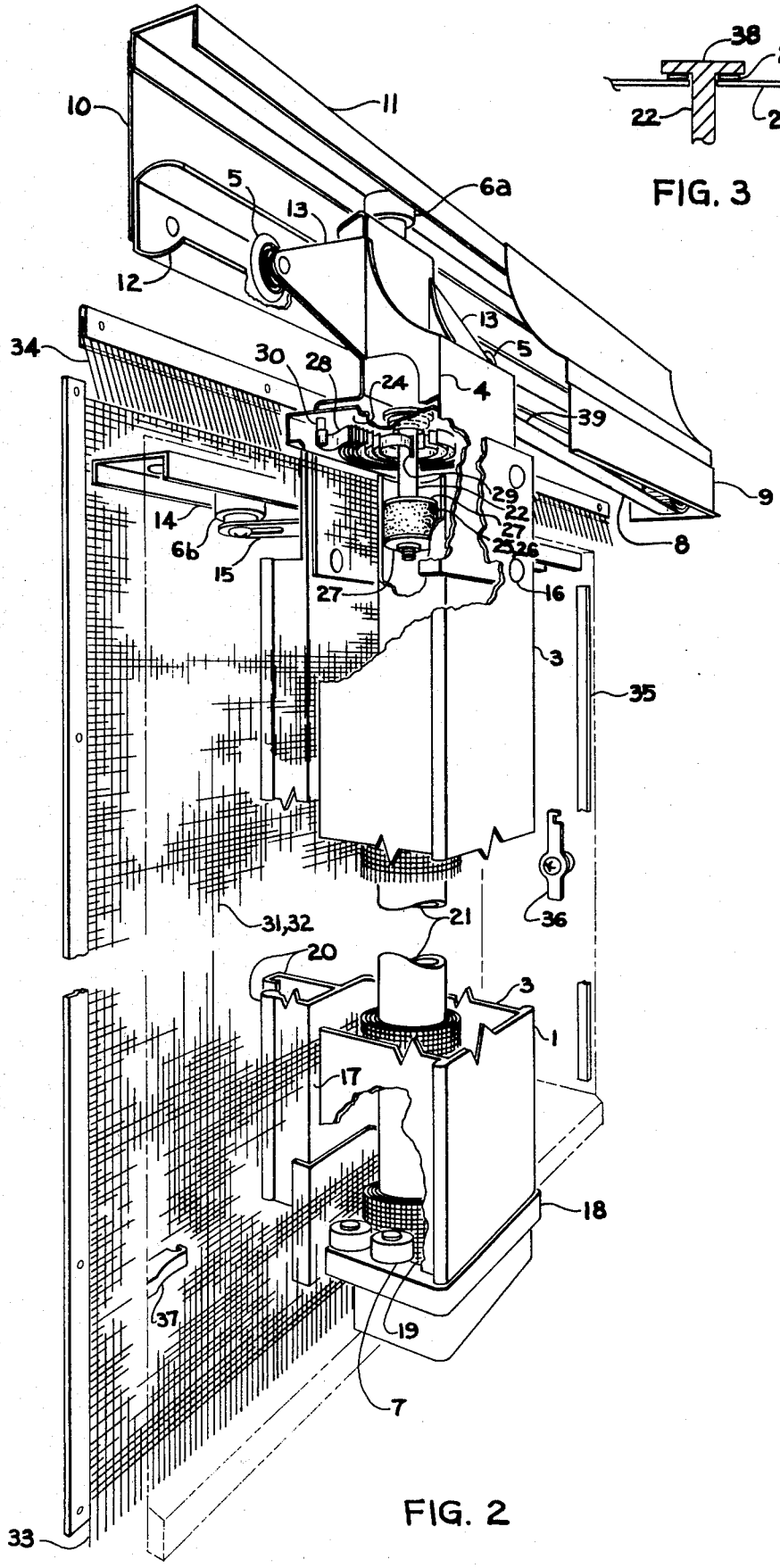
FIG. 2 is a perspective view of the invention showing details of construction and assembly.

By reference to both FIGS. 1 and 2, it can be seen that the barrier 1 consists of a main track guide 10, horizontally mounted to the outside (foreward) of a conventional door header. Said guide 10 has a C-channel shaped and downwardly facing upper track 11 and a circular shaped lower track 12. A carrier member 4 of a generally hollow rectangular shape is slideably and rollably engaged to said guide 10 by an upper roller *6a* having a vertical axis rollably engaging said upper track 11. Additionally, two complimentary horizontal rollers 5, outboardly attached to said member 4 by extension elements 13 and having horizontal axes, rollably engage said lower track 12. Said horizontal rollers 5 carry the total hanging weight of said barrier 1 and have a sectional profile conforming to that of said lower track 12 such that said rollers 5 are retained therein and cannot become disengaged therefrom.

A C-channel shaped and downwardly facing auxiliary track guide 14 is mounted to the underside of the door header. A lower roller *6b*, similar to said upper roller *6a* and attached to the aft side of said member 4 by a lower roller support 15, rollably engages said guide 14. Said support 15 is adjustable fore and aft such that both said rollers *6a*, *6b* complimentarily press against their respective guides 11, 14 to eliminate all fore and aft movement of said carrier member 4. The unique combination of rollers described above provide an extremely stable and vertically rigid mounting while providing an easily rollable said member 4.

A hollow rectangular shaped housing 3 is rigidly attached to said member 4 by fastener means 16 such that said housing 3 is vertically stable to said member 4. Said housing extends the full height of the doorway. An opening or slot 17, wherein the interior of said housing 3 is opened to its exterior, traverses the full length of said housing 3. A bottom frame 18, with an aperture 19 thereon, partially encloses the lower end of said housing 3 while maintaining the continuity of said slot 17 extending through the lower end of said housing 3. Projections 20 on the inner or aft side of said housing 3 serve both as structural stiffeners for said housing 3 and as handles for manual operation of said barrier 1.

Traversing the full length of and circumscribed by said housing 3 is a hollow cylindrical shaped spool 21. Said spool 21 is rotatably attached to said member 4 by means of a vertical shaft 22 within the upper end of said spool 21 and projecting through an opening on a horizontal plate 24 within said member 4. A bearing 23, attached to the plate 24, radially secures said shaft 22 thereto. A disk cap 38, fastened to the upper end of and larger in diameter than said shaft 22, prevents any downward axial travel of said shaft 22. A vertical attachment means 25, on the lower end of said shaft 22 and within the upper most end of said spool 21, pivotably and rotationally secures said spool 21 to said shaft 22. Said means 25, as illustrated, comprises a resilient washer shaped grommet 26 with circular washers 27 on the top and bottom thereof such that by compressing said grommet 26 with a standard threaded fastener, the grommet's 26 outside diameter expands. Said expansion forces the compressed grommet 26 against the inside surface of said spool 21. Thus the spool 21 is securely attached to said shaft 22 and is pivotal thereat due to the grommet's 26 flexibility.

A coiled torsion spring 26, such as a spiral motor spring, circumscribes said shaft 22 and has its inner end attached thereto through a spring retainer 29 on said shaft 22. The outer end of said spring 28 is attached to a spring pin 30 securely attached to the bottom side of said plate 24. The use and novelty of said spring 28 will be described below.

A flexible barrier material 31, such as an insect screen 32 as illustrated and having the same rectangular shape as the doorway, is vertically fixed by one end thereof to the side of the doorway. The screen's 32 other end is attached to and wrapped around said spool 21 by passing through said slot 17 such that said screen 32 is capable of completely covering the doorway. Said spring 28 applies a continuous torsional force on said spool 21 to automatically wrap the screen 32 onto the spool 21 such that there is a continuous tension force upon the full height of the screen 32. Therefore, as the housing/member 3, 4 moves laterally across the doorway opening, the spool 21 also moves laterally and rolls or unrolls the screen 32 wrapped thereon to uncover or cover the doorway. It is this tension force which keeps said screen 32 taut and sagless in the closed position.

Two roller tension guides 7, located on said bottom frame 18, are positioned about said aperture 19 to maintain forcible contact with the rolled screen 32 and spool 21. This forcible contact is instrumental in said spool's free rotation without engaging said aperture 19 and in maintaining said spool 21 in a near vertical attitude. Additionally, the rolled screen 32 diameter changes proportionally to the barrier's 1 opened or closed position as additional layers or thicknesses of screen 32 is rolled or unrolled upon said spool 21. The above attachment means 25, functioning as a pivotal universal joint, permits said spool 21 to be easily angularly displaced against said guides 7 without sacrifice of barrier 1 operation.

The lower edge of said screen 32 has a bottom fringe 33 of screen material in which horizontal threads have been deleted, leaving only vertical threads. Said fringe 33 extends downward sufficiently to touch the doorway threshold and thereby functions as a barrier to crawling insects. The deletion of said horizontal threads provide extreme flexibility to said fringe 33, thereby providing ease of conforming to all shapes of thresholds while applying minimum restraint to barrier 1 operation.

An upper fringe 34 of the same material and construction as said lower fringe 33, is attached to the doorway header such that it forwardly projects downward and contacts the uppermost edge of said screen 32 in its closed position. By this method, the upper most edge of said screen 32 is sealed from flying insects while said fringe 34 presents no restraint to barrier 1 operation.

Said housing 3, being of carbon steel material, is held in the closed position by a magnetic strip 35 attached to the doorway's right hand side. The magnetic closure force associated with said strip 35 and housing 3 is sufficient to resist the accumulative tension force of said spring 28, wind gusts and small animals acting on the screen 32, but is easily overcome manually by individuals. A mechanical latch 36, on the inside of the doorway, is used to positively lock said barrier 1 in the closed position.

On the lower left hand side of said doorway is a stabilizing catch pin 37 which horizontally projects toward said housing 3. Said pin 37 interfaces with said housing 3 as it approaches the full opened position and slideably engages the exterior surface thereon, and guides said housing 3 to a secured open or registered position.

Said barrier material 31 is not limited to insect screen 32 but may be of a clear plastic, moisture proof film for use as a shower door within a bathroom or to separate a moist/damp room from a dry room. Additionally, a material 31 of fire or heat resistant fabric can be used in a barrier 1 used as a fire or smoke door within hotels, hospitals and the like. In industry, a barrier 1 with suitable material 31 will prevent toxic fumes and/or dust from passing from a contaminated area to a non-contaminated area.

A cover 9, illustrated in FIG. 1, is used to hide said guide 10 and member 4 from view and to present an esthetically pleasing barrier 1.

It is obvious that said spring 28 force not only maintains said material 31 in a taut attitude by reacting directly upon said spool, but also automatically opens said barrier 1 by reacting directly upon said member 4. Thus the above tautness and rate of self opening are proportionally dependent upon each other, i.e., high tautness means high rate of opening. To obtain the desired function of high tautness with moderate opening rate, the preferred embodiment uniquely utilizes a constant force negator spring 8, mounted to the right side of said guide 10 with its free end 39 attached to said member 4. The force from said negator spring 8 thus reacts directly upon said member 4 and does not affect said tautness.

Having thus described my invention, what I claim is:

1. A horizontally traversing door barrier for covering and uncovering a doorway, said barrier comprising;

a flexible material having one vertical end attached to a side of said doorway for its full height, a cylindrical shaped vertical spool with a length approximately that of said doorway's height and upon which said material is rolled and unrolled, a carrier member which rollably engages and horizontally traverses upon a main track guide horizontally mounted above said doorway, a vertical shaft rotationally engaging said member and pivotably engaging the upper end of said spool, a coiled torsion spring circumscribing and attached to said shaft for applying continuous torque to said spool, a hollow rectangular shaped housing which circumscribes said spool and rolled material for its total length and which is secured to said member, a lengthwise slot within said member through which said material freely traverses, and tension guides at the lower end of said member for rollable engagement of said spool such that as said member, spool and housing horizontally traverse upon said guide, said material is rolled or unrolled upon said spool and respectively uncovers or covers said doorway.

2. The barrier of claim 1 wherein said member has complimentary horizontal rollers extending from its upper end and an upper roller at its uppermost end, and said guide has a downwardly facing upper track for rollably engaging said upper roller, and a circular shaped lower track for rollably engaging said horizontal rollers, such that said housing is stable and easily rollable across the doorway.

3. The barrier of claim 2 wherein an auxiliary track guide is mounted to the underside of the doorway's header, and said member has a lower roller adjustably attached thereto for rollable engagement to said auxiliary track guide, such that by such adjustment, said lower and upper rollers complimentarily press against their respective guides for a very stable and easily rollable member.

4. The barrier of claim 1 wherein said housing is of a carbon steel material, and a magnetic strip is vertically attached to the side of the doorway such that said strip will magnetically secure said housing in a barrier closed position.

5. The barrier of claim 1 wherein said material is a flexible insect screen to prevent passage of insects through the doorway.

6. The barrier of claim 1 wherein a downwardly projecting upper fringe is attached to the doorway header to contact and seal from insects the uppermost edge of said material in a closed position.

7. The barrier of claim 5 wherein said screen has horizontal threads therein, and a bottom fringe at its lower edge in which horizontal threads have been deleted for ease of touchably conforming to all thresholds, thereby preventing entry of crawling insects without restraint upon said rotation spool.

8. The barrier of claim 1 wherein said material is of a moisture proof plastic film to prevent passage of moisture.

9. The barrier of claim 1 wherein said material is of a heat resistant fabric to prevent passage of heat and smoke.

* * * * *